US010293906B1

(12) United States Patent
Pelini

(10) Patent No.: US 10,293,906 B1
(45) Date of Patent: May 21, 2019

(54) VARIABLE MULTI ENGINE JACK PLATE

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 303 days.

(21) Appl. No.: 15/258,130

(22) Filed: Sep. 7, 2016

(51) Int. Cl.
*B63H 20/06* (2006.01)
*B63H 20/10* (2006.01)

(52) U.S. Cl.
CPC ..... *B63H 20/106* (2013.01); *B63H 20/06* (2013.01)

(58) Field of Classification Search
CPC ..... B63H 20/106; B63H 20/02; B63H 5/20; B63H 5/125
See application file for complete search history.

(56) References Cited

U.S. PATENT DOCUMENTS 4,624,438 A * 11/1986 Goodman, Jr. ..... B63H 20/106 248/642
5,782,662 A * 7/1998 Icenogle ..... B63H 20/106 248/641
6,126,498 A 10/2000 Icenogle
6,890,227 B1 * 5/2005 Alby ..... B63H 20/10 248/640
7,416,459 B1 * 8/2008 Pelini ..... B63H 20/106 440/61 R
7,527,539 B1 * 5/2009 Pelini ..... B63H 20/08 440/61 R
7,883,384 B1 * 2/2011 Williams ..... B63H 5/125 114/151
8,657,637 B1 * 2/2014 Pelini ..... B63H 20/106 440/53
8,801,479 B1 * 8/2014 Quail ..... B63H 20/106 440/53
2005/0070180 A1 * 3/2005 von Wolske ..... B63B 39/061 440/55
2007/0221113 A1 * 9/2007 Detwiler ..... B63H 20/106 114/285
2007/0232160 A1 * 10/2007 Mullen ..... B63H 20/06 440/55
2010/0136859 A1 * 6/2010 von Wolske ..... B63H 5/125 440/66
2011/0111654 A1 * 5/2011 Porta ..... B63H 20/106 440/61 R

* cited by examiner

*Primary Examiner* — Tyrone V Hall, Jr.
(74) *Attorney, Agent, or Firm* — Edward P. Dutkiewicz

(57) ABSTRACT

A variable multiple engine jack plate, comprising, in combination, a motor plate, a pair of center plate connectors, a pair of outer slides and a pair of inner slides.
There is at least one hydraulic cylinder coupling the motor plate and the slides. There is a hydraulic pump system having a pump and a hydraulic fluid flow control valve and a hydraulic fluid reservoir holding a volume of hydraulic fluid.

13 Claims, 5 Drawing Sheets

VARIABLE MULTI ENGINE JACK PLATE

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

Field of the Invention

The present invention relates to a variable, variable multi engine jack plate and more particularly pertains to a jack plate which can be configured to mount a variety of outboard motors by adjusting the location of the right and left center plate connector, using the symmetrically located sets of holes in the motor plate.

Description of the Prior Art

The use of jack plates to mount motors is known in the prior art. More specifically, jack plates to mount motors previously devised and utilized for the purpose of having a means of raising or lowering an outboard motor are known to consist basically of familiar, expected, and obvious structural configurations, notwithstanding the number of designs encompassed by the prior art which has been developed for the fulfillment of a number of objectives and requirements.

While the prior art devices fulfill their respective, particular objectives and requirements, the prior art does not describe a variable, multi engine jack plate that allows a user to mount different sets of outboard motors on a boat using a jack plate.

In this respect, the variable, multi engine jack plate, according to the present invention, substantially departs from the conventional concepts and designs of the prior art, and in doing so provides an apparatus primarily developed for the purpose of allowing a user to mount a variety of sets of outboard motors on a jack plate.

Present variations of available multi engine jack plates are motor specific, that is, only motors having like mounting points may be used. The present invention uses a number of symmetrically located holes whereby the center plate may be moved together or apart, so as to accommodate a variety of differently configured mounting points of different outboard motors.

Therefore, it can be appreciated that there exists a continuing need for a new and improved variable, multi engine jack plate which can be used for mounting a variety of outboard motors. In this regard, the present invention substantially fulfills this need.

SUMMARY OF THE INVENTION

In view of the foregoing disadvantages inherent in the known types of jack plates of mount motors now present in the prior art, the present invention provides an improved variable, multi engine jack plate. As such, the general purpose of the present invention, which will be described subsequently in greater detail, is to provide a new and improved variable, multi engine jack plate which has all the advantages of the prior art and none of the disadvantages.

To attain this, the present invention essentially comprises several components, in combination. First, there is a motor plate. The motor plate is fabricated of a rigid material. The motor plate has a generally rectilinear configuration with a proximal surface which mounts toward a boat transom and a distal surface which is located away from the boat transom. The motor plate has a thickness between the proximal motor plate surface and the distal motor plate surface, forming an edge. The motor plate edge runs the periphery of the motor plate, the edge comprising an upper edge, a lower edge, and a pair of like-configured side edges. The motor plate side edges each having a step therein.

The motor plate has a plurality of mounting holes therethrough. The motor plate has a plurality of travel stop mounting holes therethrough. The motor plate has a plurality of symmetrically located center plate connector holes therethrough.

The motor plate has a plurality of pairs of hydraulic cylinder ram mounting tabs, with each of the mounting tabs having a ram pin hole therethrough. The tabs allow a ram from a hydraulic cylinder to be coupled to the motor plate. Each pair of motor plate mounting tab ram pin holes has an associated ram pin for coupling the ram to the tabs.

Next there is a motor mounting subassembly which comprises a pair of inner slides and a pair of outer slides.

Next there is a two piece center plate connector. The center plate connector is fabricated of a rigid material. The center plate connector has a right center plate connector and a left center plate connector. The right center plate connector and left center plate connector are discontinuous with each other. The center plate connector is fixedly coupled to the motor plate through the plurality of symmetrically located bolt holes. Each center plate connector piece has a distal surface with a plurality of threaded bolt holes there in, with each threaded bolt hole having an associated bolt.

The right center plate connector and the left center plate connector each have a generally proximal T-shaped configuration. The proximal T-shaped configuration of each center plate connector has a proximal end, with the proximal end of the right center plate connecter being coupled to the distal surface of the motor plate. The right center plate connector and the left center plate connector are mirror images of each other.

The right center plate connector piece and the left center plate connector piece of the center plate connector each have a center plate connector cross strut travel slot therethrough. Each of the pieces of the center plate connector have a generally rectilinear distal portion.

The T-shaped connector threaded bolt holes of the right center plate connector and the left center plate connector are aligned with the symmetrically located motor plate center plate connector holes. Each of the T-shaped connector connecting bolts are threadely received into the bolt holes in the proximal end of each of the center plate connectors.

Each proximal T-shaped connector of each of the center plate connectors has an upper edge and a lower edge. The upper edge of each proximal T-shaped connector of each of the center plate connectors has a generally stepped configuration, and the lower edge of each proximal T-shaped connector of the center plate connectors has a generally planar configuration.

Next there is a pair of outer slides. Each of the outer slides is fabricated of a rigid material. The outer slides are a right outer slide and a left outer slide, with each of the outer slides being slidably coupled to the motor plate. The left outer slide and the right outer slide are mirror images of each other. Each of the outer slides has a proximal portion and a distal portion.

The proximal portion of each of the outer slides has a generally C-shaped configuration, forming a motor plate groove therein. The motor plate groove of each of the outer slides has an associated groove liner.

The distal portion of the right outer slide and the distal portion of the left outer slide each have a generally L-shaped configuration, with a proximally oriented leg and an inwardly oriented leg.

The proximally oriented leg of the right outer slide is continuous with the proximal portion of the right outer slide. The proximally oriented leg of the left outer slide is continuous with the proximal portion of the left outer slide. Each proximal portion of each outer slide has an associated grease fitting.

Each of the proximally oriented legs of the outer slides each has a plurality of strut bolt apertures therethrough. Each of the distal inwardly oriented legs of the outer slides each have a plurality of motor mounting bolt apertures therethrough. The grease fitting of each of the outer slides being located in a grease fitting recess.

There is next a pair of inner slides. The inner slides being a right inner slide and a left inner slide. Each inner slide has a proximal portion and a distal portion. Each distal portion of each inner slide has an associated grease fitting therethrough. The outwardly oriented leg of the distal portion of each inner slide has a generally planar configuration, with each inner slide distal portion having a step located therein. The outwardly oriented leg of the distal portion of the right inner slide is continuous with the proximal portion of the right inner slide. The outwardly oriented leg of the left inner slide is continuous with the proximal portion of the left inner slide. Each of the distal, outwardly oriented legs of the inner slides have a plurality of motor mounting bolt apertures therethrough.

The left inner slide and the right inner slide are mirror images of each other. Each inner slide has a proximal portion and a distal portion. The distal portion of each inner slide has a generally right angled configuration, with a proximally oriented leg and an outwardly oriented leg.

The proximally oriented leg of the distal portion each inner slide has a connector plate groove therein. The connector plate groove of each of the proximally oriented legs of the distal portions of the inner slides have an associated groove liner.

The outwardly oriented leg of the distal portion of each inner slide has a generally planar configuration, with each inner slide distal portion having a step located therein. The outwardly oriented leg of the distal portion of each inner slide has a plurality of motor mounting holes therethrough.

There is a right lower outer cross bar. The right lower outer cross bar is fabricated of a rigid material. The right lower outer cross bar has a generally rectilinear configuration, with an inner end and an outer end. The inner end of the right lower outer cross bar and the outer end of the right lower outer cross bar each have a threaded bolt hole therein. The inner end of the right lower outer cross bar threaded bolt hole and the outer end of the right lower outer cross bar threaded bolt hole each have an associated bolt.

Next there is a left lower outer cross bar. The left lower outer cross bar is fabricated of a rigid material. The left lower outer cross bar has a generally rectilinear configuration, with an inner end and an outer end. The inner end of the left lower outer cross bar and the outer end of the left lower outer cross bar each have a threaded bolt hole therein. The inner end of the left lower outer cross bar threaded bolt hole and the outer end of the left lower outer cross bar threaded bolt hole each have an associated bolt.

Next there is a right lower inner cross strut. The right lower inner cross strut is fabricated of a rigid material. The right lower inner cross strut has a generally solid rounded bar configuration, with an inner end and an outer end. The inner end of the right lower inner cross strut and the outer end of the right lower inner cross strut each have a threaded bolt hole therein. The inner end of the right lower inner cross strut threaded bolt hole and the outer end of the right lower inner cross strut threaded bolt hole each have an associated bolt.

There is next a left lower inner cross strut. The left lower inner cross strut is fabricated of a rigid material. The left lower inner cross strut has a generally solid rounded bar configuration with an inner end and an outer end. The inner end of the left lower inner cross strut and the outer end of the left lower inner cross strut each have a threaded bolt hole therein. The inner end of the left lower inner cross strut threaded bolt hole and the outer end of the left lower inner cross strut threaded bolt hole each have an associated bolt.

There is next a right upper outer cross bar. The right upper outer cross bar is fabricated of a rigid material. The right upper outer cross bar has a generally rectilinear configuration, with an inner end and an outer end. The inner end of the right upper outer cross bar and the outer end of the right upper outer cross bar each have a threaded bolt hole therein. The inner end of the right upper outer cross bar threaded bolt hole and the outer end of the right upper outer cross bar threaded bolt hole each having an associated bolt.

Next there is a left upper outer cross bar. The left upper outer cross bar is fabricated of a rigid material. The left upper outer cross bar has a generally rectilinear configuration, with an inner end and an outer end. The inner end of the left upper outer cross bar and the outer end of the left upper outer cross bar each have a threaded bolt hole therein. The inner end of the left upper outer cross bar threaded bolt hole and the outer end of the left upper outer cross bar threaded bolt hole each have an associated bolt.

Next there is a right upper inner cross strut. The right upper inner cross strut is fabricated of a rigid material. The right upper inner cross strut has a generally solid rounded bar configuration, with an inner end and an outer end. The inner end of the right upper inner cross strut and the outer end of the right upper inner cross strut each have a threaded bolt hole therein. The inner end of the right upper inner cross strut threaded bolt hole and the outer end of the right upper inner cross strut threaded bolt hole each have an associated bolt.

Next there is a left upper inner cross strut. The left upper inner cross strut is fabricated of a rigid material. The left upper inner cross strut has a generally solid rounded bar configuration, with an inner end and an outer end. The inner end of the left upper inner cross strut and the outer end of the left upper inner cross strut each has a threaded bolt hole therein. The inner end of the left upper inner cross strut threaded bolt hole and the outer end of the left upper inner cross strut threaded bolt hole each have an associated bolt.

Next there is a center plate connector cross strut. The center connector cross strut is fabricated of a rigid material. The center plate connector cross strut has a generally solid rounded bar configuration, with a right end and an left end. The right end of the center plate connector cross strut and the left end of the center plate connector cross strut each have a threaded bolt hole therein. The right end of the center plate connector cross strut bolt hole and the left end of the center plate connector cross strut threaded bolt hole each have an associated bolt. The center plate connector cross strut couples each of the inner slides, with the center plate connector cross strut passing through the center plate connector cross strut travel slot of the right center plate connector and the left center plate connector.

The right lower outer cross bar, the right lower inner cross strut, the right upper outer cross bar, and the right upper inner cross strut each rigidly couple the right inner slide and the right outer slide.

The left lower outer cross bar, the left lower inner cross strut, the left upper outer cross bar, and the left upper inner cross strut each rigidly couple the left inner slide and the left outer slide.

Next there is a plurality of hydraulic cylinders. Each hydraulic cylinder has a case and a ram with a ram pin hole therethrough. Each hydraulic cylinder case has a pair of fluid lines coupled thereto.

Next there is a plurality of travel stops. Each of the travel stops is fabricated of a rigid material. Each of the travel stops has a rectilinear configuration. Each travel stop has a proximal end and a distal end. The proximal end of each travel stop has a pair of threaded mounting bolt holes therein. Each of the proximal ends of the travel stops is coupled to the distal surface of the motor plate.

There is a plurality of position indicators. Each of the position indicators has a generally rectilinear configuration with a surface having spaced indicia.

Lastly, there is a hydraulic pump system. The hydraulic pump system has a power source, a switch, a pump, a hydraulic fluid flow control valve, a hydraulic fluid reservoir holding a volume of hydraulic fluid, and a fluid pressure equalizer. The fluid pressure equalizer has an inlet which is coupled to the hydraulic pump. The fluid pressure equalizer has at least two outlets, with an outlet being coupled by a fluid path to each of the hydraulic cylinders.

The variable multiple engine jack plate has a moving means. The term "moving means" includes hydraulic cylinders with pumps, valves, power supplies and switches. Moving means may include pressure equalizing hydraulic connectors. Moving means also includes screws, levers, pulleys and cables, as well as mechanical jacks.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved variable, multi engine jack plate which has all of the advantages of the prior art jack plates used to mount motors, and none of the disadvantages.

It is another object of the present invention to provide a new and improved variable, multi engine jack plate which may be easily and efficiently manufactured and marketed.

It is further object of the present invention to provide a new and improved variable, multi engine jack plate which is of durable and reliable constructions.

An even further object of the present invention is to provide a new and improved variable, multi engine jack plate which is susceptible of a low cost of manufacture with regard to both materials and labor, and which accordingly is then susceptible of low prices of sale to the consuming public, thereby making such variable, multi engine jack plate economically available to the buying public.

Even still another object of the present invention is to provide a variable, multi engine jack plate for a jack plate which is can be configured to mount a variety of outboard motors.

Lastly, it is an object of the present invention to provide a new and improved variable multiple engine jack plate, comprising, in combination, a motor plate, a pair of center plate connectors, a pair of outer slides and a pair of inner slides.

There is at least one hydraulic cylinder coupling the motor plate and the slides. There is a hydraulic pump system having a pump and a hydraulic fluid flow control valve and a hydraulic fluid reservoir holding a volume of hydraulic fluid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
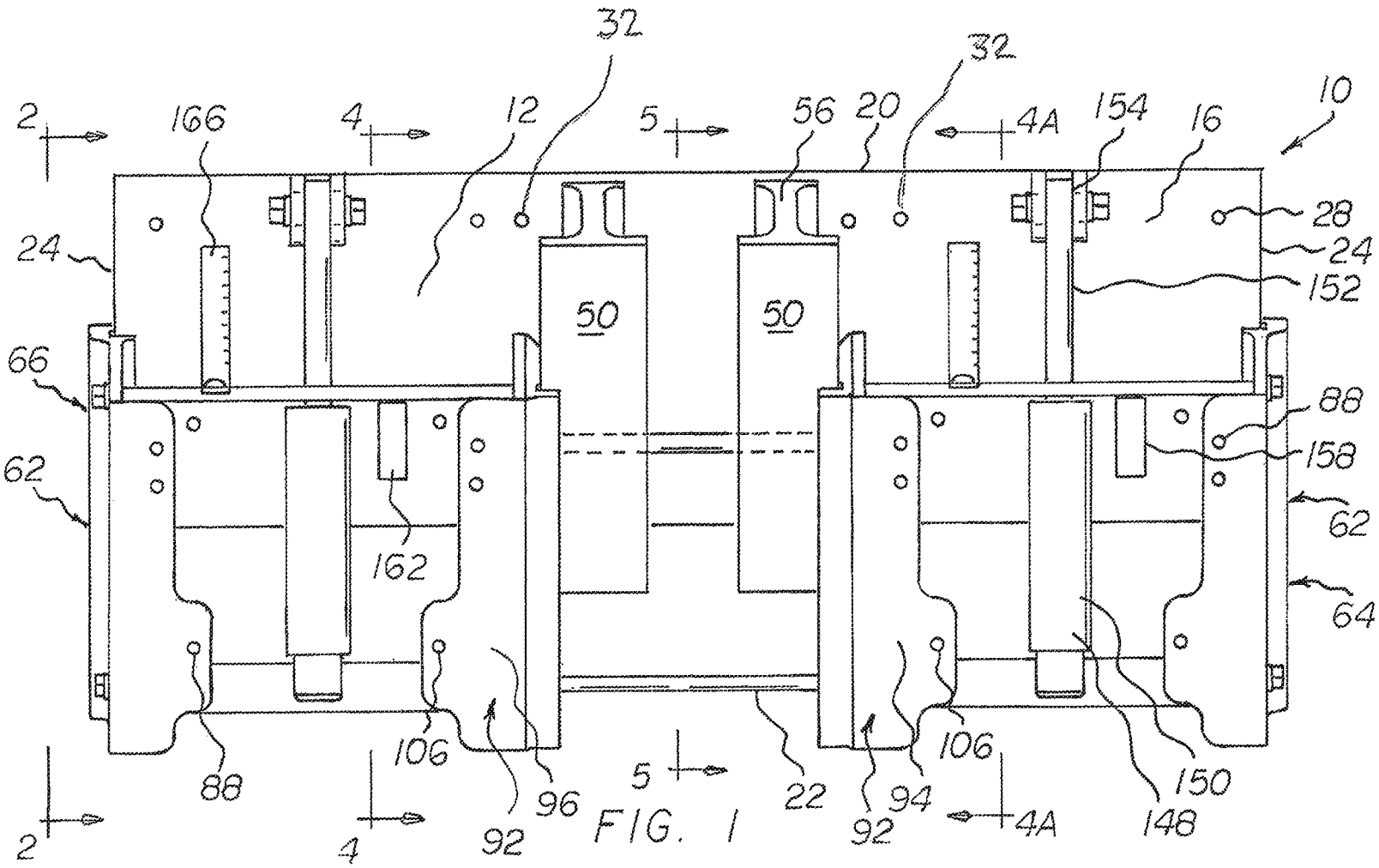
FIG. 1 is perspective view taken from a distal orientation.
Figure 2:
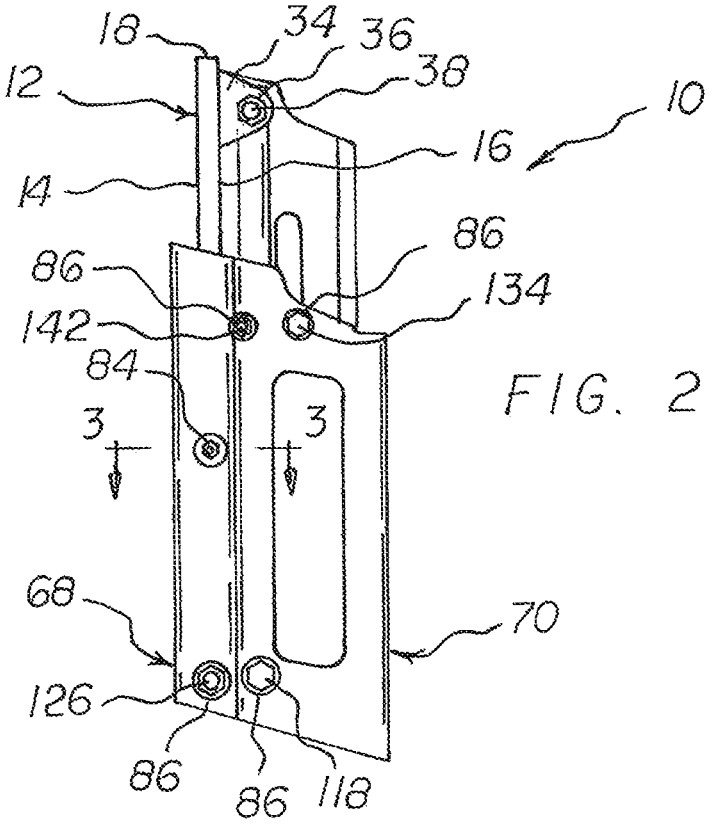
FIG. 2 is a view taken along line 2-2 of FIG. 1.
Figure 3:
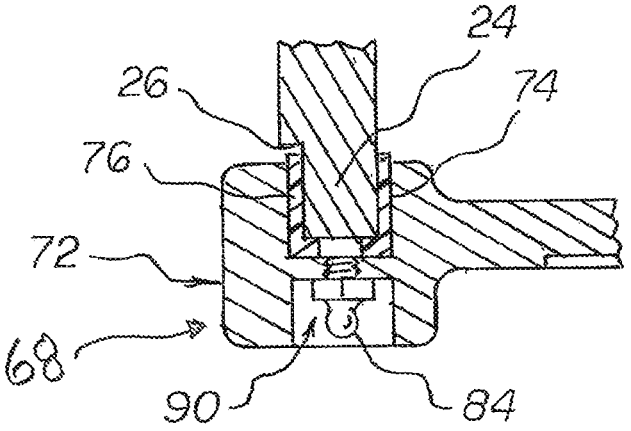
FIG. 3 is a view taken along line 3-3 of FIG. 2.
Figure 4:
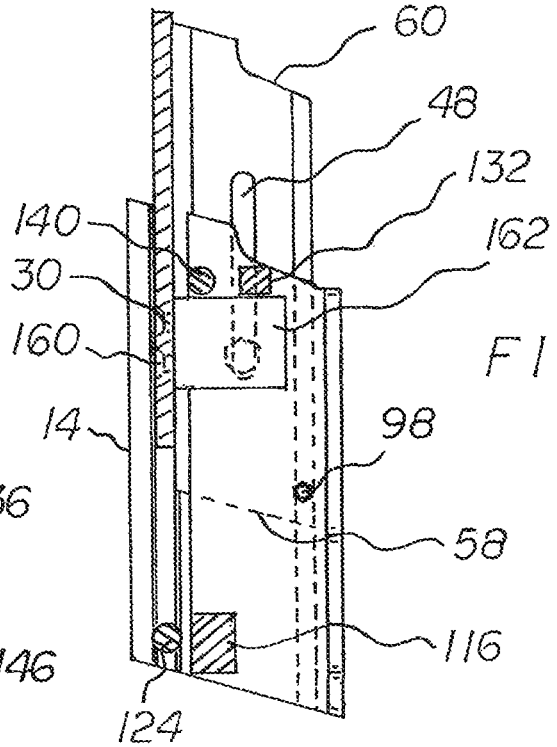
FIG. 4 is a view taken along line 4-4 of FIG. 1.
Figure 4A:
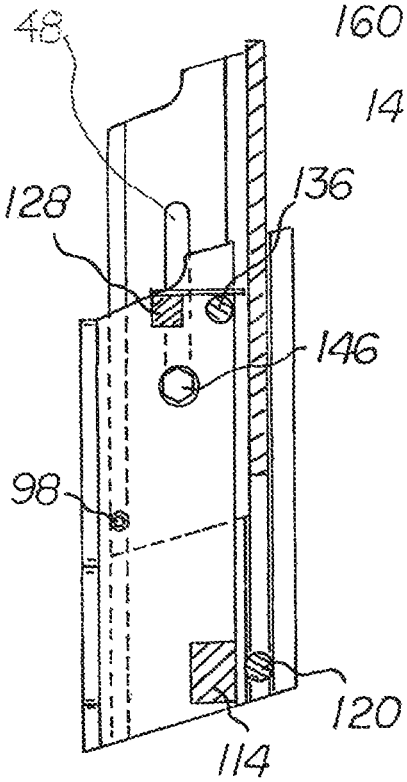
FIG. 4A is a view taken along line 4A-4A of FIG. 1.
Figure 5:
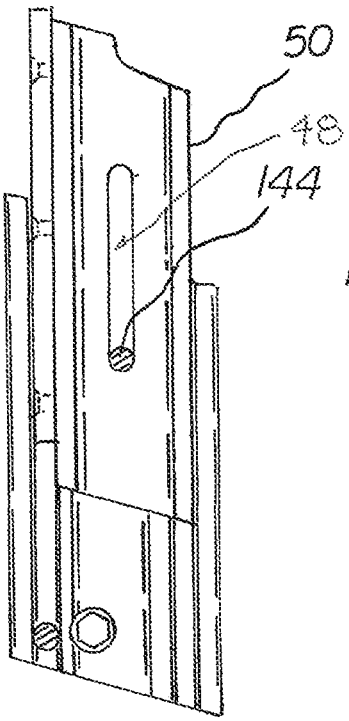
FIG. 5 is a view taken along line 5-5 of FIG. 1.
Figure 6:
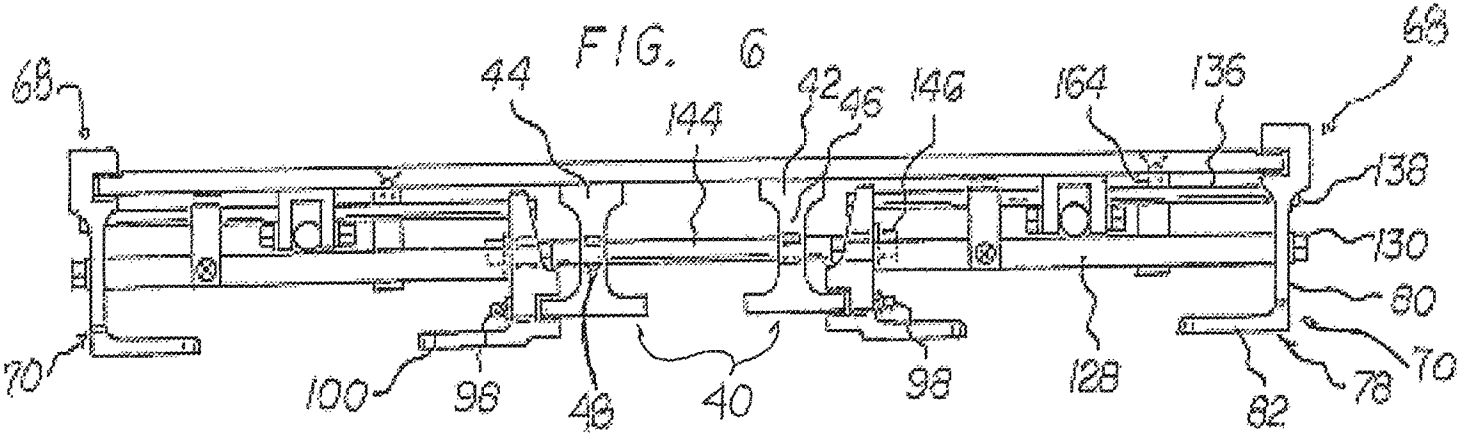
FIG. 6 is a top plan view of the variable multi engine jack plate.
Figure 7:
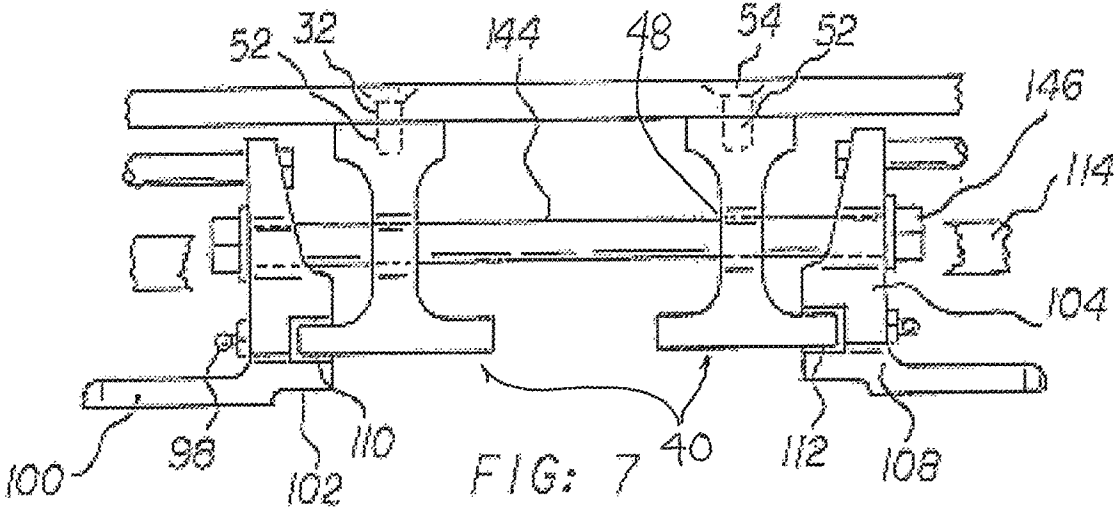
FIG. 7 is a close up view of a top plan view of the right center plate connector and the left center plate connector, showing the coupling of the inner slides with the center plate connectors.
Figure 8:
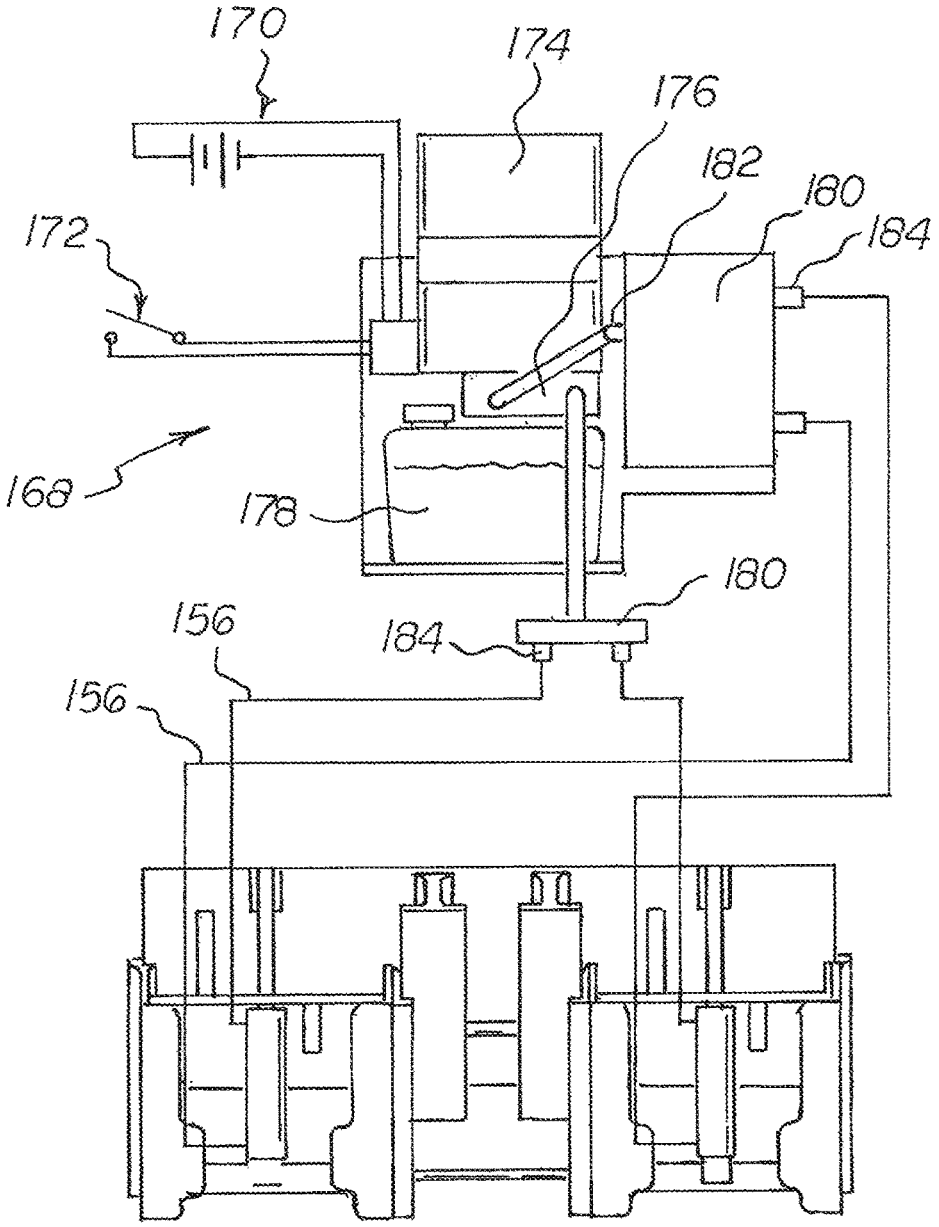
FIG. 8 is a schematic view of the hydraulic system and the control system for the operation of the hydraulics.

With reference now to the drawings, and in particular to FIG. 1 thereof, the preferred embodiment of the new and improved variable, multi engine jack plate embodying the principles and concepts of the present invention and generally designated by the reference numeral 10 will be described.

The present invention, the variable, multi engine jack plate 10 is comprised of a plurality of components. Such components in their broadest context include a motor plate, a pair of center plate connectors, a pair of outer slides and a pair of inner slides. Such components are individually configured and correlated with respect to each other so as to attain the desired objective. A multiple engine jack plate, comprising several components, in combination.

A multiple engine jack plate 10, comprising several components, in combination, is herein described.

First, there is a motor plate 12. The motor plate is fabricated of a rigid material. The motor plate has a generally rectilinear configuration with a proximal surface 14 which mounts toward a boat transom and a distal surface 16 which is located away from the boat transom. The motor plate has a thickness between the proximal motor plate surface and the distal motor plate surface, forming an edge 18. The motor plate edge runs the periphery of the motor plate, the edge comprising an upper edge 20, a lower edge 22, and a pair of like-configured side edges 24. The motor plate side edges each having a step 26 therein.

The motor plate has a plurality of mounting holes 28 therethrough. The motor plate has a plurality of travel stop mounting holes 30 therethrough. The motor plate has a plurality of symmetrically located center plate connector holes 32 therethrough. The symmetry of the location of the connector plate holes allows for a user to attach a variety of outboard motors to the jack plate. The variable multiple engine jack plate is configured and constructed to be able to be adaptable to receive a number of different outboard motors by moving the location of the right connecting plate and the left connecting plate to accommodate the different outboard motor widths.

The motor plate has a plurality of pairs of hydraulic cylinder ram mounting tabs 34, with each of the mounting tabs having a ram pin hole 36 therethrough. The tabs allow a ram from a hydraulic cylinder to be coupled to the motor plate. Each pair of motor plate mounting tab ram pin holes has an associated ram pin 38 for coupling the ram to the tabs.

Next there is a two piece center plate connector 40. The two piece center plate connector is fabricated of a rigid material. The two piece center plate connector has a right center plate connector 42 and a left center plate connector 44. The right center plate connector and left center plate connector are discontinuous with each other. The two pieced center plate connector is fixedly coupled to the motor plate, through a plurality of symmetrically located bolt holes in the motor plate. The symmetrically located multiple sets of bolt holes through the transom allows for the mounting of a plurality of different makes and models of outboard engines.

The right center plate connector and the left center plate connector each has a generally proximal T-shaped configuration 46. The proximal T-shaped configuration is coupled to the distal surface of the motor plate.

The right center plate connector and the left center plate connector are mirror images of each other. The right center plate connector and the left center plate connector each have a center plate connector cross strut travel slot 48 therethrough. The right center plate connector and the left center plate connector each has a generally rectilinear distal portion 50.

Each center plate connector proximal T-shaped connector has a plurality of threaded bolt holes 52 therein, with the T-shaped connector threaded bolt holes being aligned with the motor plate center plate connector holes. Each of the T-shaped connector threaded bolt holes have an associated connecting bolt 54.

Each proximal T-shaped connector of the right center plate connector and the left center plate connector has an upper edge 56 and a lower edge 58. The upper edge of each proximal T-shaped connector of the right center plate connector and the left center plate connector has a generally stepped 60 configuration, and the lower edge of each proximal T-shaped connector of the center plate connector has a generally planar configuration.

Next there is a motor mounting subassembly which comprises a pair of inner slides and a pair of outer slides.

There is a pair of outer slides 62. Each of the outer slides is fabricated of a rigid material. The outer slides are a right outer slide 64 and a left outer slide 66, with each of the outer slides being slidably coupled to the motor plate. The left outer slide and the right outer slide are mirror images of each other. Each of the outer slides has a proximal portion 68 and a distal portion 70.

The proximal portion of each of the outer slides has a generally C-shaped configuration 72, forming a motor plate groove 74 therein. The motor plate groove of each of the outer slides has an associated groove liner 76.

The distal portion of the right outer slide and the distal portion of the left outer slide each have a generally L-shaped configuration 78, with a proximally oriented leg 80 and an inwardly oriented leg 82.

The proximally oriented leg of the right outer slide is continuous with the proximal portion of the right outer slide. The proximally oriented leg of the left outer slide is continuous with the proximal portion of the left outer slide. Each proximal portion of each outer slide has an associated grease fitting 84.

Each of the proximally oriented legs of the outer slides each has a plurality of strut bolt apertures 86 therethrough. Each of the distal inwardly oriented legs of the outer slides each have a plurality of motor mounting bolt apertures 88 therethrough. The grease fitting of each of the outer slides being located in a grease fitting recess 90.

There is next a pair of inner slides 92. The inner slides being a right inner slide 94 and a left inner slide 96. Each distal portion of each inner slide has an associated grease fitting 98 therethrough. Each inner slide has an outwardly oriented leg 100. The outwardly oriented leg of the distal portion of each inner slide has a generally planar configuration, with each inner slide distal portion having a step 102 located therein. Each inner slide has a proximal portion 104. The outwardly oriented leg of the distal portion of the right inner slide is continuous with the proximal portion of the right inner slide. The outwardly oriented leg of the left inner slide is continuous with the proximal portion of the left inner slide. Each of the distal, outwardly oriented legs of the inner slides have a plurality of motor mounting bolt apertures 106 therethrough.

The left inner slide and the right inner slide are mirror images of each other. The distal portion of each inner slide has a generally right angled configuration 108.

The proximally oriented leg of the distal portion each inner slide has a connector plate groove 110 therein. The connector plate groove of each of the proximally oriented legs of the distal portions of the inner slides have an associated groove liner 112.

The outwardly oriented leg of the distal portion of each inner slide has a generally planar configuration.

There is a right lower outer cross bar 114. The right lower outer cross bar is fabricated of a rigid material. The right lower outer cross bar has a generally rectilinear configuration, with an inner end and an outer end. The inner end of the right lower outer cross bar and the outer end of the right lower outer cross bar each have a threaded bolt hole therein. The inner end of the right lower outer cross bar threaded bolt hole and the outer end of the right lower outer cross bar threaded bolt hole each have an associated bolt.

Next there is a left lower outer cross bar 116. The left lower outer cross bar is fabricated of a rigid material. The left lower outer cross bar has a generally rectilinear configuration, with an inner end and an outer end. The inner end of the left lower outer cross bar and the outer end of the left lower outer cross bar each have a threaded bolt hole therein. The inner end of the left lower outer cross bar threaded bolt hole and the outer end of the left lower outer cross bar threaded bolt hole each have an associated bolt 118.

Next there is a right lower inner cross strut 120. The right lower inner cross strut is fabricated of a rigid material. The right lower inner cross strut has a generally solid rounded bar configuration, with an inner end and an outer end. The inner end of the right lower inner cross strut and the outer end of the right lower inner cross strut each have a threaded bolt hole therein. The inner end of the right lower inner cross strut threaded bolt hole and the outer end of the right lower inner cross strut threaded bolt hole each have an associated bolt.

There is next a left lower inner cross strut 124. The left lower inner cross strut is fabricated of a rigid material. The left lower inner cross strut has a generally solid rounded bar configuration with an inner end and an outer end. The inner end of the left lower inner cross strut and the outer end of the left lower inner cross strut each have a threaded bolt hole therein. The inner end of the left lower inner cross strut threaded bolt hole and the outer end of the left lower inner cross strut threaded bolt hole each have an associated bolt 126.

There is next a right upper outer cross bar 128. The right upper outer cross bar is fabricated of a rigid material. The right upper outer cross bar has a generally rectilinear configuration, with an inner end and an outer end. The inner end of the right upper outer cross bar and the outer end of the right upper outer cross bar each have a threaded bolt hole therein. The inner end of the right upper outer cross bar threaded bolt hole and the outer end of the right upper outer cross bar threaded bolt hole each having an associated bolt 130.

Next there is a left upper outer cross bar 132. The left upper outer cross bar is fabricated of a rigid material. The left upper outer cross bar has a generally rectilinear configuration, with an inner end and an outer end. The inner end of the left upper outer cross bar and the outer end of the left upper outer cross bar each have a threaded bolt hole therein. The inner end of the left upper outer cross bar threaded bolt hole and the outer end of the left upper outer cross bar threaded bolt hole each have an associated bolt 134.

Next there is a right upper inner cross strut 136. The right upper inner cross strut is fabricated of a rigid material. The right upper inner cross strut has a generally solid rounded bar configuration, with an inner end and an outer end. The inner end of the right upper inner cross strut and the outer end of the right upper inner cross strut each have a threaded bolt hole therein. The inner end of the right upper inner cross strut threaded bolt hole and the outer end of the right upper inner cross strut threaded bolt hole each have an associated bolt 138.

Next there is a left upper inner cross strut 140. The left upper inner cross strut is fabricated of a rigid material. The left upper inner cross strut has a generally solid rounded bar configuration, with an inner end and an outer end. The inner end of the left upper inner cross strut and the outer end of the left upper inner cross strut each has a threaded bolt hole therein. The inner end of the left upper inner cross strut threaded bolt hole and the outer end of the left upper inner cross strut threaded bolt hole each have an associated bolt 142.

Next there is a center plate connector cross strut 144. The center connector cross strut is fabricated of a rigid material. The center plate connector cross strut has a generally solid rounded bar configuration, with a right end and an left end. The right end of the center plate connector cross strut and the left end of the center plate connector cross strut each have a threaded bolt hole therein. The right end of the center plate connector cross strut bolt hole and the left end of the center plate connector cross strut threaded bolt hole each have an associated bolt 146. The center plate connector cross strut couples each of the inner slides, with the center plate connector cross strut passing through the right center plate connector cros strut travel slot and the left center plate connector cross strut travel slot.

The right lower outer cross bar, the right lower inner cross strut, the right upper outer cross bar, and the right upper inner cross strut each rigidly couple the right inner slide and the right outer slide.

The left lower outer cross bar, the left lower inner cross strut, the left upper outer cross bar, and the left upper inner cross strut each rigidly couple the left inner slide and the left outer slide.

Next there is a plurality of hydraulic cylinders 148. Each hydraulic cylinder has a case 150 and a ram 152 with a ram pin hole therethrough 154. Each hydraulic cylinder case has a pair of fluid lines 156 coupled thereto.

Next there is a plurality of travel stops 158. Each of the travel stops is fabricated of a rigid material. Each of the travel stops has a rectilinear configuration. Each travel stop has a proximal end 160 and a distal end 162. The proximal end of each travel stop has a pair of threaded mounting bolt holes 164 therein. Each of the proximal ends of the travel stops is coupled to the distal surface of the motor plate.

There is a plurality of position indicators 166. Each of the position indicators has a generally rectilinear configuration with a surface having spaced indicia.

Lastly, there is a hydraulic pump system 168. The hydraulic pump system has a power source 170, a switch 172, a pump 174, a hydraulic fluid flow control valve 176, a hydraulic fluid reservoir holding a volume of hydraulic fluid 178, and a fluid pressure equalizer 180. The fluid pressure equalizer has an inlet 182 which is coupled to the hydraulic pump. The fluid pressure equalizer has at least two outlets 184, with an outlet being coupled by a fluid path to each of the hydraulic cylinders.

The variable multiple engine jack plate has a moving means. The term "moving means" includes hydraulic cylinders with pumps, valves, power supplies and switches. Moving means may include pressure equalizing hydraulic connectors. Moving means also includes screws, levers, pulleys and cables, as well as mechanical jacks.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A variable multiple engine jack plate, comprising, in combination:

a motor plate having a generally rectilinear configuration with a proximal surface which mounts toward a boat transom and a distal surface which is located away from the boat transom, with a thickness between the proximal motor plate surface and the distal motor plate surface, forming an edge, with the edge running the periphery of the motor plate, the edge comprising an upper edge and a lower edge and a pair of like-configured side edges;

a two piece center plate connector comprising a right center plate connector and a left center plate connector, the right center plate connector and left center plate connector being discontinuous, the two pieced center plate connector being coupled to the motor plate;

a motor mounting subassembly comprising a pair of outer slides being a right outer slide and a left outer slide with each of the outer slides being slidably coupled to the motor plate, and a pair of inner slides being a right inner slide and a left inner slide with each of the inner slides each being slidably coupled to the center plate connector;

the motor plate having a plurality of mounting holes therethrough, with the motor plate having a plurality of travel stop mounting holes therethrough, the motor plate having a plurality of symmetrically located center plate connector holes therethrough, the plurality of symmetrically located center plate bolt holes located on the motor plate allowing for variable coupling of the right and left center plate connector to the motor plate for different size outboard engines;

at least one hydraulic cylinder with each cylinder having a case and a ram and a ram pin hole therein, the hydraulic cylinder being coupled to the motor plate and the motor mounting subassemblies, each hydraulic cylinder case having a pair of fluid lines coupled thereto; and a hydraulic pump system having a pump and a hydraulic fluid flow control valve and a hydraulic fluid reservoir holding a volume of hydraulic fluid.

2. The variable multiple engine jack plate, as described in claim 1, with the jack plate further comprising:

the left outer slide and the right outer slide being mirror images of each other, with each outer slide having a proximal portion and a distal portion; and the hydraulic pump having a power source and a switch.

3. The variable multiple engine jack plate, as described in claim 2, with the jack plate further comprising:

the motor plate having a plurality of pairs of hydraulic cylinder ram mounting tabs with each of the mounting tabs having a ram pin hole therethrough;

the two pieced center plate connectors each having a generally proximal T-shaped configuration with the proximal T-shaped configuration being coupled to the distal surface of the motor plate;

the proximal portion of each outer slide having a generally C-shaped configuration forming a motor plate groove therein;

the left inner slide and the right inner slide being mirror images of each other, with each inner slide having a proximal portion and a distal portion, with the distal portion of each inner slide having a generally right angled configuration with a proximally oriented leg and an outwardly oriented leg;

a right lower outer cross bar having a generally rectilinear configuration with an inner end and an outer end;

a left lower outer cross bar having a generally rectilinear configuration with an inner end and an outer end;

a right lower inner cross strut having a generally solid rounded bar configuration with an inner end and an outer end;

a left lower inner cross strut having a generally solid rounded bar configuration with an inner end and an outer end;

a right upper outer cross bar having a generally rectilinear configuration with an inner end and an outer end;

a left upper outer cross bar having a generally rectilinear configuration with an inner end and an outer end;

the right lower outer cross bar and the right lower inner cross strut and the right upper outer cross bar rigidly coupling the right outer side and right inner side, and the left lower outer cross bar and the left lower inner cross strut and the left upper outer cross bar rigidly coupling the left outer side and left inner side;

each hydraulic cylinder case having a pair of fluid lines coupled thereto; and the hydraulic pump system having a fluid pressure equalizer, equalizer having an inlet which is coupled to the hydraulic pump and the equalizer having at least two outlets, with an outlet being coupled by a fluid path to each of the hydraulic cylinders.

4. The variable multiple engine jack plate, as described in claim 3, with the jack plate further comprising:

the motor plate side edges each having a step therein;

the right center plate connector piece of the center plate connector and the left center plate connector piece of the center plate connector being a mirror image of each other;

the distal portion of the right outer slide and the distal portion of the left outer slide each having a generally L-shaped configuration with a proximally oriented leg and an inwardly oriented leg;

the proximally oriented leg of the distal portion each inner slide having a connector plate groove therein;

the outwardly oriented leg of the distal portion of each inner slide having a generally planar configuration with each inner slide distal portion having a step located therein;

the inner end of the right lower outer cross bar and the outer end of the right lower outer cross bar each having a threaded bolt hole therein, with the inner end of the right lower outer cross bar threaded bolt hole and the outer end of the right lower outer cross bar threaded bolt hole each having an associated bolt;

the inner end of the left lower outer cross bar and the outer end of the left lower outer cross bar each having a threaded bolt hole therein, with the inner end of the left lower outer cross bar threaded bolt hole and the outer end of the left lower outer cross bar threaded bolt hole each having an associated bolt;

the inner end of the right lower inner cross strut and the outer end of the right lower inner cross strut each having a threaded bolt hole therein, with the inner end of the right lower inner cross strut threaded bolt hole and the outer end of the right lower inner cross strut threaded bolt hole each having an associated bolt;

the inner end of the left lower inner cross strut and the outer end of the left lower inner cross strut each having a threaded bolt hole therein, with the inner end of the left lower inner cross strut threaded bolt hole and the outer end of the left lower inner cross strut threaded bolt hole each having an associated bolt;

the inner end of the right upper outer cross bar and the outer end of the right upper outer cross bar each having a threaded bolt hole therein, with the inner end of the right upper outer cross bar threaded bolt hole and the outer end of the right upper outer cross bar threaded bolt hole each having an associated bolt; and the inner end of the left upper outer cross bar and the outer end of the left upper outer cross bar each having a threaded bolt hole therein, with the inner end of the left upper outer cross bar threaded bolt hole and the outer end of the left upper outer cross bar threaded bolt hole each having an associated bolt.

5. The variable multiple engine jack plate, as described in claim 4, with the jack plate further comprising:

the right center plate connector piece of the center plate connector and the left center plate connector piece of the center plate connector each having a center plate connector cross strut travel slot therethrough, right center plate connector piece of the center plate connector and the left center plate connector piece of the center plate connector each a generally rectilinear distal portion;

the motor plate groove of each of the outer slides having an associated groove liner;

the proximally oriented leg of the right outer slide being continuous with the proximal portion of the right outer slide and the proximally oriented leg of the left outer slide being continuous with the proximal portion of the left outer slide;

the connector plate groove of each of the proximally oriented legs of the distal portions of the inner slides each having an associated groove liner;

the outwardly oriented leg of the distal portion of the right inner slide being continuous with the proximal portion of the right inner slide and the outwardly oriented leg of the left inner slide being continuous with the proximal portion of the left inner slide;

a right upper inner cross strut having a generally solid rounded bar configuration with an inner end and an outer end, with the right upper inner cross strut coupling the right inner slide and the right outer slide;

a left upper inner cross strut having a generally solid rounded bar configuration with an inner end and an outer end, with the left upper inner cross strut coupling the left inner slide and the left outer slide; and a center plate connector cross strut having a generally solid rounded bar configuration with a right end and an left end.

6. The variable multiple engine jack plate, as described in claim 5, with the jack plate further comprising:

each pair of motor plate mounting tab ram pin holes having an associated ram pin;

the proximal T-shaped connector of the right center plate connector and the left center plate connector each having a plurality of threaded bolt holes therein with each of the T-shaped connectors having a plurality of threaded bolt holes being aligned with the motor plate center plate connector holes, with each of the T-shaped connector threaded bolt holes in the transom having an associated connecting bolt;

the inner end of the right upper inner cross strut and the outer end of the right upper inner cross strut each having a threaded bolt hole therein, with the inner end of the right upper inner cross strut threaded bolt hole and the outer end of the right upper inner cross strut threaded bolt hole each having an associated bolt;

the inner end of the left upper inner cross strut and the outer end of the left upper inner cross strut each having a threaded bolt hole therein, with the inner end of the left upper inner cross strut threaded bolt hole and the outer end of the left upper inner cross strut threaded bolt hole each having an associated bolt; and the right end of the center plate connector cross strut and the left end of the center plate connector cross strut each having a threaded bolt hole therein, with the right end of the center plate connector cross strut bolt hole and the left end of the center plate connector cross strut threaded bolt hole each having an associated bolt, the center plate connector cross strut coupling each of the inner slides with the center plate connector cross strut passing through the right center plate connector cross strut travel slot and the left center plate connector cross strut travel slot.

7. The variable multiple engine jack plate, as described in claim 6, with the jack plate further comprising:

each T-shaped connector of the right center plate connector and each T-shaped connector the left center plate connector each having an upper edge and a lower edge;

each proximal portion of each outer slide having an associated grease fitting;

each of the proximally oriented legs of the outer slides each having a plurality of strut bolt apertures therethrough, each of the distal inwardly oriented legs of the outer slides each having a plurality of motor mounting bolt apertures therethrough;

the distal portion of each inner slide having an associated grease fitting therein; and each of the distal outwardly oriented legs of the inner slides each having a plurality of motor mounting bolt apertures therethrough.

8. The variable multiple engine jack plate, as described in claim 7, with the jack plate further comprising:

the upper edge of each T-shaped connector of the right center plate connector and the upper edge of each T-shaped connector of the left center plate connector each having a generally stepped configuration and the lower edge of each T-shaped connector of the right center plate connector and the left center plate connector each having a generally planar configuration;

the grease fitting of each outer slide being located in a grease fitting recess;

the proximal portion of each inner slide having a generally beveled configuration; and a plurality of travel stops with each travel stop having a rectilinear configuration, each travel stop having a proximal end and a distal end, each travel stop being coupled to the motor plate.

9. The variable multiple engine jack plate, as described in claim 8, with the jack plate further comprising:

the proximal end of each travel stop having a pair of threaded mounting bolt holes therein, each of the proximal ends of the travel stops being coupled to the distal surface of the motor plate; and a plurality of position indicators, with each position indicator having a generally rectilinear configuration with a surface having spaced indicia.

10. A variable multiple engine jack plate, comprising, in combination:

a motor plate having a generally rectilinear configuration with a proximal surface which mounts toward a boat transom, a distal surface which is located away from the boat transom, and a plurality of symmetrically located center plate connector holes therethrough;

a two piece center plate connector comprising a right center plate connector and a left center plate connector, the right center plate connector and left center plate connector being discontinuous, wherein the plurality of symmetrically located center plate holes located on the motor plate allow for variable coupling of the right and left center plate connectors to the motor plate for different size outboard engines;

a pair of outer slides coupled to the motor plate; and a pair of inner slides being coupled to each of the pieces of the center plate connector.

11. The variable multiple engine jack plate as described in claim 10, with the jack plate further comprising:

at least one moving means, the moving means being coupled to the motor plate and the inner slides;

each of the outer slides being slidably coupled to the motor plate and each of the inner slides being slidably coupled to the two piece center plate connector; and wherein the right center plate connector and the left center plate connector each having a slot therein.

12. The variable multiple engine jack plate as described in claim 11, with the jack plate further comprising:

a center plate connector cross strut having a generally solid rounded bar configuration with a right end and an left end with the center plate connector cross strut coupling the inner slides, with the center plate connector cross strut passing through the center connector slot of the right center plate connector and the center connector slot of the left center plate connector;

the moving means being at least one hydraulic cylinder with each cylinder having a case and a ram and a ram pin hole therein, the hydraulic cylinder ram being coupled to at least one inner slide and at least one outer slide, the hydraulic cylinder case being coupled to the transom, with each hydraulic cylinder case having a pair of fluid lines coupled thereto, the moving means further comprising a hydraulic pump system having a pump and a hydraulic fluid flow control valve and a hydraulic fluid reservoir holding a volume of hydraulic fluid.

13. The variable multiple engine jack plate, as described in claim 12, with the jack plate further comprising:

the motor plate having a plurality of mounting holes therethrough, with the motor plate having a plurality of travel stop mounting holes therethrough, the left outer slide and the right outer slide being mirror images of each other, with each outer slide having a proximal portion and a distal portion; and the hydraulic pump having a power source and a switch.

* * * * *